United States Patent [19]

Ljungkvist et al.

[11] Patent Number: 4,576,510

[45] Date of Patent: Mar. 18, 1986

[54] TECHNIQUE FOR THE LOCATION OF EXPANSION JOINTS WHEN CASTING A CONCRETE BED

[76] Inventors: Stig-åke Ljungkvist, Bäckvägen 26, S-541 35 Skövde; Lennart Johansson, Snuggenäsgatan 3, S-542 00 Mariestad, both of Sweden

[21] Appl. No.: 568,182

[22] PCT Filed: Apr. 25, 1983

[86] PCT No.: PCT/SE83/00162

§ 371 Date: Dec. 28, 1983

§ 102(e) Date: Dec. 28, 1983

[87] PCT Pub. No.: WO83/03862

PCT Pub. Date: Nov. 10, 1983

[30] Foreign Application Priority Data

May 3, 1982 [SE] Sweden ..... 8202755

[51] Int. Cl.[4] ..... E01C 10/04

[52] U.S. Cl. ..... 404/49; 404/47; 404/68

[58] Field of Search ..... 404/47, 68, 52, 49, 404/56, 59, 62; 52/396; 14/16.5

[56] References Cited

U.S. PATENT DOCUMENTS

| | | | |
|---|---|---|---|
| 712,541 | 11/1902 | Jacques . | |
| 1,255,050 | 1/1918 | Quinby . | |
| 1,369,161 | 2/1921 | Benson et al. . | |
| 1,756,856 | 4/1930 | Galassi . | |
| 2,023,472 | 12/1935 | Heltzel . | |
| 2,179,911 | 11/1939 | Wilmoth . | |
| 2,244,297 | 6/1941 | Heltzel . | |
| 2,308,677 | 1/1943 | Dailey | 404/52 |
| 2,425,883 | 8/1947 | Jackson . | |
| 2,428,562 | 10/1947 | Foulger . | |
| 2,498,472 | 2/1950 | Yeoman | 404/52 |
| 4,115,976 | 9/1978 | Rohrer . | |
| 4,285,612 | 8/1981 | Betti | 404/68 |

FOREIGN PATENT DOCUMENTS

| | | | |
|---|---|---|---|
| 1017198 | 8/1955 | Fed. Rep. of Germany . | |
| 6516743 | 6/1967 | Netherlands | 404/68 |
| 545393 | 1/1974 | Switzerland . | |
| 421293 | 1/1935 | United Kingdom . | |

*Primary Examiner*—Stephen J. Novosad
*Assistant Examiner*—William P. Neuder
*Attorney, Agent, or Firm*—Allegretti, Newitt, Witcoff & McAndrews

[57] ABSTRACT

Procedure of locating expansion joints (7) in a concrete bed (3,4) during manufacture (casting) by locating prefabricated joint elements (11,12) consisting of long rails made of reinforced concrete in pairs as a form and glide path (1,2) for smoothing and vibrating machines and in such a way that the cavity formed is filled (7) with material which has a lower E-modulus than concrete. The procedure also describes a method when two rails are secured to another by means of an adhesive. The rails (11,12) are designed to form a tongue and groove (9,10) between the rail concerned and the associated concrete slab (3,4). Holes are made for dowels (6,8) which extend from one slab to the other through the joint element and thus prevent edge raising from occuring later on.

7 Claims, 1 Drawing Figure

TECHNIQUE FOR THE LOCATION OF EXPANSION JOINTS WHEN CASTING A CONCRETE BED

BACKGROUND OF THE INVENTION

Swedish patent application No. 801663-7 describes a technique of simplifying and cutting the price of the manufacture of concrete slabs on a solid bed. The product, which has been given the registered trademark name of Permaban, has become a great marketing success.

Permaban consists of non-tensioned reinforced concrete rails with a length of 5.1 m. They are often also referred to as tracks. These rails are available in different heights according to the desired thickness of the concrete floor. The work using Permaban is carried out in the following way: The rails are laid out in such a way that the surface to be concreted is divided up into different sections, the width of which corresponds to the width permitted by the equipment. A usual width of vibrators is 5 or 8 meters. The rails are levelled off and secured by means of spots of concrete at a distance of about 1.7 m from each other. The upper edge of the rails is levelled off to the desired position corresponding to the upper edge of the concrete bed. This provides forms and glide paths for concrete and vibrators. It is not necessary to strip forms or wait for the bay to set before starting casting work on the adjacent bay.

As this information indicates, labour is saved and quality improved by using Permaban.

As is always the case, when one problem is solved, or at least simplified, other problems turn up which are very difficult. This is also the case with the application of Permaban. Before we consider the problems, some information about the joints in concrete floors.

Differentiation is made in concreting between working joints, contraction joints and expansion joints. The first-mentioned joint is used to provide a sharp edge at the end of the concreting bay, so that next day the concrete adheres to the earlier concrete. This problem has been solved in an excellent way by Permaban. The rails can be used to close off one section and, by using the Permaban dowel holes, you can provide a working joint that meets the highest demands.

Contraction joints are needed to absorb the contraction that results when the concrete hardens. This has proved to be yet another application for Permaban, which makes up a good crack indication and therefore provides controlled contraction cracks which can be considered to be hair-fine.

Unfortunately, it has not been possible to use Permaban in order to solve the third type of joint problem. Expansion joints must absorb the movements that occur in a concrete bed resulting from tensions such as thermal stresses. Normally, when the forms are struck after concreting, some forms are left to serve as joints. Unfortunately, wood is a poor jointing material and, furthermore, dowels cannot be used in connection with this procedure. The absence of dowels means that the edge raising problem becomes more obvious. This means that the quality of the floor decreases and problems may be encountered, for example when operating fork lift trucks with heavy loads.

Another way of producing expansion joints, at a later occasion after the concrete bed has hardened, is to use special concrete saws to cut joints and then fill them with elastic material. This procedure is time-taking and thereby expensive. It is often also difficult to obtain straight joints. This particular invention now represents a method which eliminates problems involved in producing a concrete bed with expansion joints of good quality and for a reasonable amount of labour and thereby cost.

SUMMARY OF THE INVENTION

It has been found possible to produce an expansion joint in connection with concreting by using two long rails of non-tensioned reinforced concrete, not necessarily similar to Permaban. If two units of this type are placed close together at at least a certain minimum distance from each other, and the space created is filled with material to keep these two units temporarily together, they can be used in principle in the same way as Permaban, i.e., as both the form and a glide path for vibrators. Later, when the concrete has hardened sufficiently, the temporary material can be replaced by suitable joint material, for example compound with good resistance to petrol (gasoline). It is also possible to consider using jointing material in the first place between the two rails.

The cross-section of the long rails is to be made up in order to meet certain mechanical demands on the joint. It has been found suitable to make up cross-sections so that the side facing the concrete has a cross-section of the tongue and groove type.

In the web of the cross-section formed by the tongue and groove, there are holes opposite each other in both rails. These holes are used for the location of dowels before concreting, the function of these dowels being to provide a connection between the two slabs and thereby eliminating the possibility of edge rising that could occur later. In order to achieve this objective, it is necessary to have a certain minimum length so that the dowels extend sufficiently far into both slabs. Furthermore, one end should be coated with bitumen so that it does not prevent movements. The bitumen prevents an excessively strong "bite" between the concrete and dowel. In this way, the dowels, which are thus securely attached to one slab, will accept movements in the other. It has also been found most practical for the space between the rails to be well defined. For reasons concerned with the possibility of absorbing movements, it has been found best to create the space between two flat and vertical surfaces. In this way, an elastic material can absorb movement without moving vertically. Otherwise there is the possibility of the material absorbing movement to creep up from the joint or down from the joint and causing damage.

Joint compound can have different compositions. It generally contains an elastomer. Certain compounds are sensitive to certain materials which may be handled on the floor concerned in the future.

BRIEF DESCRIPTION OF THE DRAWING

This FIGURE is a cross section of an expansion joint employing the preferred joint structure of the invention formed according to the preferred method.

DETAILED DESCRIPTION OF THE PREFERRED EMBODIMENT

Figure 1:
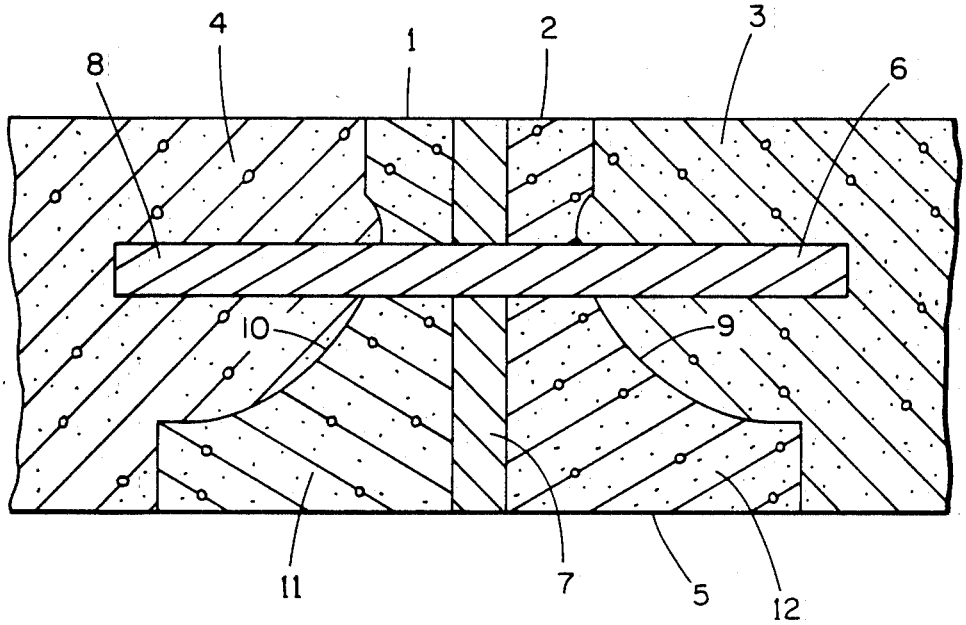

A FIGURE is enclosed to provide an example of the method. The FIGURE of the accompanying drawing includes the two long rails (11 and 12) of non-tensioned reinforced concrete (no reinforcing bars can be seen in the FIGURE) as a cross-section in the final construction. The adjacent concrete slabs (4 and 3) consist of concrete that is either reinforced against cracks with mesh or steel in order to provide a structural floor. No reinforcing bars are shown in the FIGURE. The two rails are designed in such a way that, on the upper surfaces (1 and 2) which have been made level with a fine surface in connection with production, it is possible to use compensating and vibrating machines, such as a vibrating beam finisher, in connection with production of the slabs. In the same way, the lower parts of the rails have been made rather wider so as to create a base against the firm ground (5) below. The sides of the rails facing the concrete are designed in such a way, see the FIGURE, that there is a connection between the base and the upper surface making up a tongue and groove. This provides the final construction with high structural strength. This is marked in the FIGURE (10 and 9). In the same way, the side surfaces facing the space between the rails have been designed in the form of a flat and vertical surface. The intermediary space (7) created is filled with material that has better capacity than concrete to absorb movement, i.e., is plastically deformable. This material may consist of various rubber compounds which have been softened by using various plasticizers but can also consist of polystyrene which expands to a suitable density. The FIGURE also includes a dowel (8) in the form of a circular section bar. One end has been treated with material which makes it easy for the dowel to move in this part of the structure (6).

It has been found to be particularly advantageous to work with an expanded form of polystyrene as the material between the rails. This can also be applied in position using adhesive in connection with the production of the rails so that, on the building site where the joint is to be located, this joint element is used in the same way as Permaban. In certain cases, the polystyrene can be permitted to remain in position in order to absorb movements or it can be removed completely or partly in order to fill the resulting cavity with another material, for example one which has greater resistance to petrol (gasoline).

We claim:

1. A method of forming an expansion joint when casting a concrete floor on a surface to be concreted, the method comprising:

precasting a pair of elongated concrete rails, each concrete rail having a smooth top surface, a first vertical surface being planar, and an opposite second vertical surface with an upper tongue, a lower tongue, and an intermediate groove;

locating the pair of elongated concrete rails with the first vertical surfaces of the rails facing each other and defining a space therebetween, the rails being separated by the space;

filling the space between the first vertical surfaces of the rails with filler material;

permanently positioning and levelling the pair of rails and filler material on the surface to be concreted where an expansion joint is desired, with the top surfaces of the rails at the height of the desired concrete floor surface;

pouring cement adjacent the pair of rails;

levelling the cement adjacent the pair of rails utilizing the top surfaces of the rails as a levelling guide; and hardening the cement adjacent the pair of rails to form the concrete floor adjacent the pair of rails, with the pair of rails remaining in place as positioned and levelled, such that the pair of rails become a permanent, integral part of the concrete floor and form an expansion joint in the concrete floor.

2. A method as in claim 1 in which the filler material is plastically deformable.

3. A method as in claim 1 in which the filler material binds the pair of rails together when the space between the first vertical surfaces of the rails is filled with the filler material such that the rails are bound together while positioned and levelled and while the cement is poured.

4. A method as in claim 1 in which the filler material is at least partially removed after hardening of the cement and replaced with a plastically deformable material.

5. A method as in claim 1 in which the pair of rails are precast with dowel holes, in which the pair of rails are located with the dowel holes opposite each other in both rails, and further comprising, before the pouring of cement, locating dowels through the dowel holes of the pair of rails, whereby the dowels eliminate edge rising along the expansion joint.

6. A structure as in claim 5 in which the upper tongue, lower tongue and intermediate groove extend continuously the full length of the rails.

7. Structure for forming an expansion joint when casting a concrete floor on a surface to be concreted, the structure comprising:

a pair of elongated, precast concrete rails, each such rail having a smooth top surface, a first vertical surface being planar, and an opposite second vertical surface with an upper tongue, a lower tongue, and an intermediate groove, the rails being located with the first vertical surfaces of the rails facing each other and defining a space therebetween, the rails being separated by the space; and, a filler material filling the space between the first vertical surfaces of the rails;

whereby the structure is usable in a method of forming an expansion joint comprising:

permanently positioning and levelling the structure on the surface to be concreted where an expansion joint is desired, with the top surfaces of the rails at the height of the desired concrete floor surface;

pouring cement adjacent the pair of rails;

levelling the cement adjacent the pair of rails utilizing the top surfaces of the rails as a levelling guide; and hardening the cement adjacent the pair of rails to form the concrete floor adjacent the pair of rails, with the pair of rails remaining in place as positioned and levelled, such that the pair of rails become a permanent, integral part of the concrete floor and form an expansion joint in the concrete floor.

* * * * *